US006695704B2

(12) United States Patent
Parsons

(10) Patent No.: US 6,695,704 B2
(45) Date of Patent: Feb. 24, 2004

(54) TACTICAL BATON ANKLE SCABBARD

(75) Inventor: Kevin Parsons, Appleton, WI (US)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

(21) Appl. No.: 10/007,161

(22) Filed: Nov. 8, 2001

(65) Prior Publication Data

US 2003/0087702 A1 May 8, 2003

(51) Int. Cl.[7] ..... A63F 3/14
(52) U.S. Cl. ..... 463/47.2; 463/47.7; 224/914
(58) Field of Search ..... 224/243, 245, 224/250, 257, 253, 914, 222, 911; 463/47.2, 47.7

(56) References Cited

U.S. PATENT DOCUMENTS

D203,101 S * 12/1965 Holder
3,637,120 A * 1/1972 Clay
3,977,582 A * 8/1976 McMahon
4,029,242 A * 6/1977 Stoesser
4,410,118 A * 10/1983 Taurisano
4,588,116 A * 5/1986 Litman
4,955,518 A 9/1990 Parsons et al.
D333,071 S * 2/1993 Lim
5,217,151 A * 6/1993 Parsons
5,263,619 A * 11/1993 Shoemaker
5,752,633 A * 5/1998 Antaki
5,947,352 A * 9/1999 Parsons
5,988,467 A * 11/1999 Brustein
6,176,402 B1 1/2001 Rogers

* cited by examiner

*Primary Examiner*—William M. Pierce
(74) *Attorney, Agent, or Firm*—Welsh & Katz, Ltd.

(57) ABSTRACT

A scabbard for carrying a baton on the limb of a user in a manner such that the baton may be quickly released from the scabbard and placed into use. The baton may include a handle to be grasped by the user and an end portion that is releasably secured to the scabbard. The scabbard includes a main body portion having a first end and a second end. The first end may include a means for fastening the main body member to the second end to secure the main body member about the user's limb. A retainer assembly including a first flap, a second flap and a support member is affixed to the main body portion releasably engages the baton to secure the baton to the main body portion.

25 Claims, 5 Drawing Sheets

TACTICAL BATON ANKLE SCABBARD

BACKGROUND OF THE INVENTION

The present invention relates generally to a sheath or scabbard for carrying a tool mechanism and is specifically directed to a scabbard for carrying an expandable tactical baton about a leg for use by law enforcement personnel. More particularly, the present invention relates to a scabbard for carrying an expandable tactical police baton around the lower leg of a user in a conveniently concealable and secure manner. The scabbard allows the baton to be quickly and easily released for use when the need arises.

Law enforcement and security personnel often desire or are required to carry weapons of intermediate force with them at all times, such as a nightstick or baton. The intermediate force weapon of choice, since its advent in the late 1980's, has been an expandable baton now generally known as the ASP® Tactical Baton manufactured by Armament Systems and Procedures, Inc., the assignee of the present invention. The expandable baton is preferred to a conventional one-piece hardwood baton, or nightstick, because it is convenient to carry and because tubular weapons (such as an expandable baton) are handle-heavy, as opposed to heavy at the striking end, and therefore easier to control.

The ASP® Tactical Baton is best described in U.S. Pat. No. 5,348,297, incorporated herein in its entirety. The expandable baton of the '297 patent is shown in FIGS. 1A and 1B in retracted and expanded forms respectively. The baton 10 is constructed of a series of telescoping heat-treatable alloy steel coaxial tubes having successively decreasing diameters that allow for nesting of each section in the next larger section. The baton includes a main section 12 that serves as the handle 9, and which is generally covered by a foam padding 2 or other suitable gripping material to provide a comfortable and secure grip. The back end 5 of the main section 12 is threaded to receive an end cap 4. The end cap 4 may further include a snap element 58, such as the male element shown in FIG. 1C, designed to cooperate with a complimentary snap element thereby providing for a means of connecting the baton with other equipment. Opposite the threaded back end 5, the baton includes a smooth knob 18, which allows the baton 10 to be used for control or defense with a reduced risk of inflicting serious or permanent injury.

Expandable batons come in a variety of sizes, usually consisting of three telescoping sections. In the retracted position, an expandable baton is just more than one third the extended length. In order for an expandable baton to be of maximum utility to the officer or other baton user, it should be able to be carried by the officer at all times while on duty, and without interfering with the mobility of the officer when it is not needed. The baton must be able to be deployed by the officer quickly whenever needed (i.e., virtually immediately).

Scabbards can be used to enable the efficient use and transport of a baton. The scabbard or sheath should allow for a wide range of deployment or withdrawal directions that may be required when in pursuit or subduing a subject. The scabbard should secure the baton to the officer during the officer's daily activities, such as when the officer is pursuing a subject and may be required to run, jump, climb over walls or fences, or move quickly up or down stairs and must not release the baton accidentally. The scabbard should secure the baton in a manner which allows for full body movement by the officer. It should allow the officer to comfortably carry the baton throughout the day including when the officer is standing or sitting. Further, the scabbard should secure the baton in a manner that limits noise which may undesirably disclose an officer's position under certain situations. Still further, the baton and scabbard must not be susceptible to use by a subject during an ensuing struggle.

Conventional leg baton scabbards known for securing a baton at the lower leg have a leather strap to be wrapped around and secured about the user's leg and a tubular leather pocket adapted to slidably receive the retracted baton and frictionally hold the stowed, retracted baton in position. The depth of such a pocket must be great enough to effectively limit the movement of the baton in horizontal directions. Scabbards incorporating such a design also require a snug fitting pocket to ensure frictional forces great enough to frictionally retain the baton during activities such as those encountered in the pursuit of a subject. The snug fitting pocket, however, has the counterproductive property of causing difficulty for the officer to remove and deploy the baton when needed. During removal of the baton the frictional forces between the baton handle and the inner wall of the pocket can cause a binding or jamming of the baton. The binding or jamming occurs because the withdrawal deviates from the axis of the tubular pocket. The jamming is exacerbated by damp or wet conditions. The inability to quickly draw the baton may compromise the safety of the law officer during their duties or may cause an officer to abandon the use of tactical batons altogether, thereby increasing the risk of the officer resorting to a higher level of force weapon.

Many conventional scabbards have a backing of sheep skin that is prone to matting under moist or wet conditions, such as from the user's perspiration. When the backing becomes matted, the secure fit to the user's leg is compromised and the scabbard may become loose. Loosening of the scabbard may cause the baton's positioning with respect to the wearer's leg to shift, often without prior notice, and thereby impede the quick and easy deployment of the baton. A loosened scabbard also exacerbates the jamming or binding during withdrawal as discussed above.

The scabbard of the present invention is worn about the lower leg, such that the baton may easily be concealed by a trouser leg or other clothing when not in use. The scabbard is adjustable to accommodate different sized officers, and adapts to either right-handed of left-handed users. The scabbard includes a backing of a pre-compacted felt material that is resistant to matting under damp or wet conditions and therefore provides for a secure attachment to the user.

The scabbard of the present invention is adapted to be used with many sizes of batons. It is adapted to provide quick, deliberate release of the baton by an officer in many directions and in wet or damp conditions. The scabbard preferably has a release mechanism which inhibits unwanted release during a struggle with a subject or during pursuit of a subject.

The foregoing and other objects, features and advantages of the present invention will appear from the following summary, description, drawings and appended claims.

SUMMARY OF THE INVENTION

A baton scabbard for carrying a baton on the lower leg of a user such that the baton may easily be released from the scabbard and placed into use. The scabbard includes a body portion and a retainer assembly. The body portion includes an upper edge and a lower edge and is adapted to be coupled to a user's leg. The body may include a first end and a second end, the first end having a means for being fastened to a second end. The second end includes a means for cooperating with the fastening means of the first end to securably fasten the body portion to a user's leg. The retainer assembly may be affixed to the body portion and is adapted to retain an expandable tactical baton. The retainer assembly includes a retainer member and a support member. The retainer member is adapted to releasably encircle the baton to limit the horizontal movement of the baton. Preferably, the retainer member includes a first flap and a second flap, the first flap overlapping the second flap and adapted to be releasably fastened to the second flap. Preferably, the flaps have a release mechanism which inhibits unwanted release of the flaps from the baton. The support member is positioned at a lower end of the retainer assembly and is adapted to releasably receive an end portion of the handle of the baton and thereby vertically support the baton, whereby the baton is secured to the user's lower leg in a convenient and quickly releasable manner.

DETAILED DESCRIPTION OF THE PREFERRED EMBODIMENTS

Figure 2:
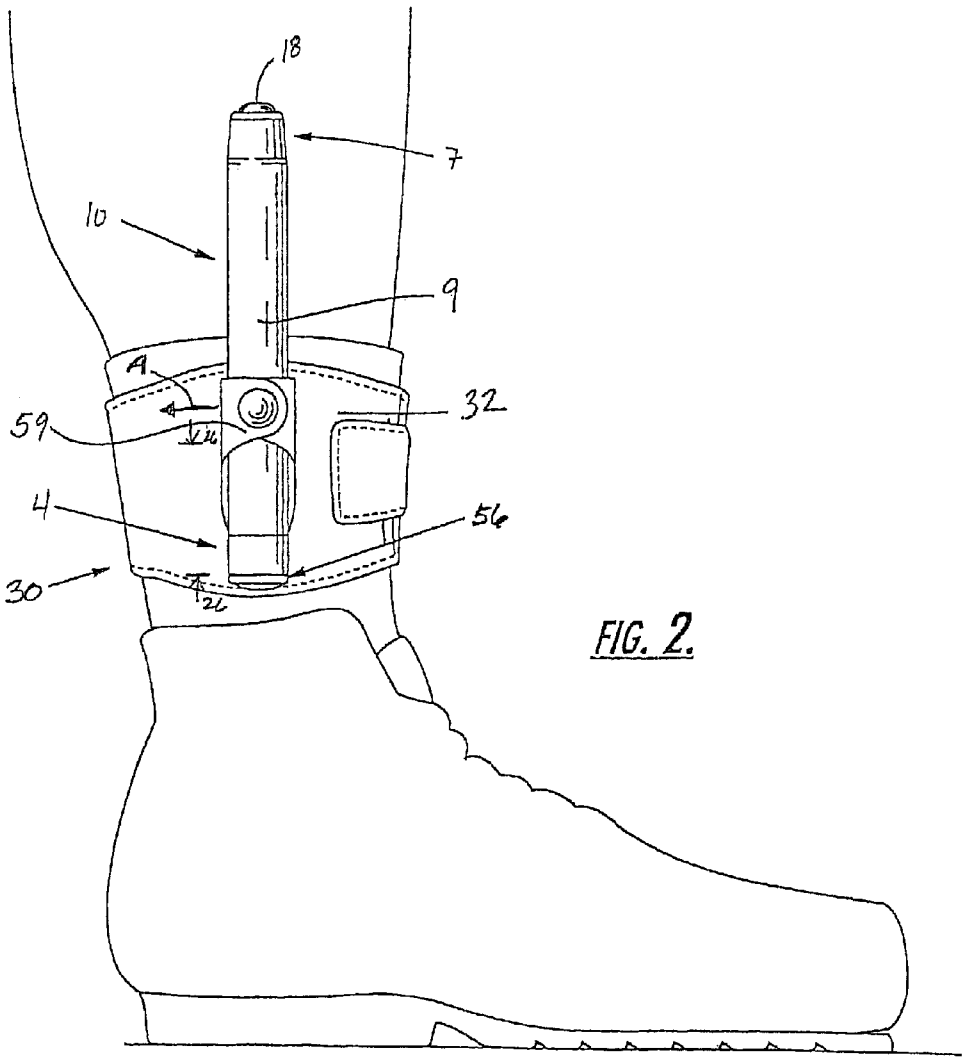
FIG. 2 is a perspective of the preferred embodiment of the present inventive scabbard showing the baton as carried by the scabbard about the users lower leg.
Figure 3:
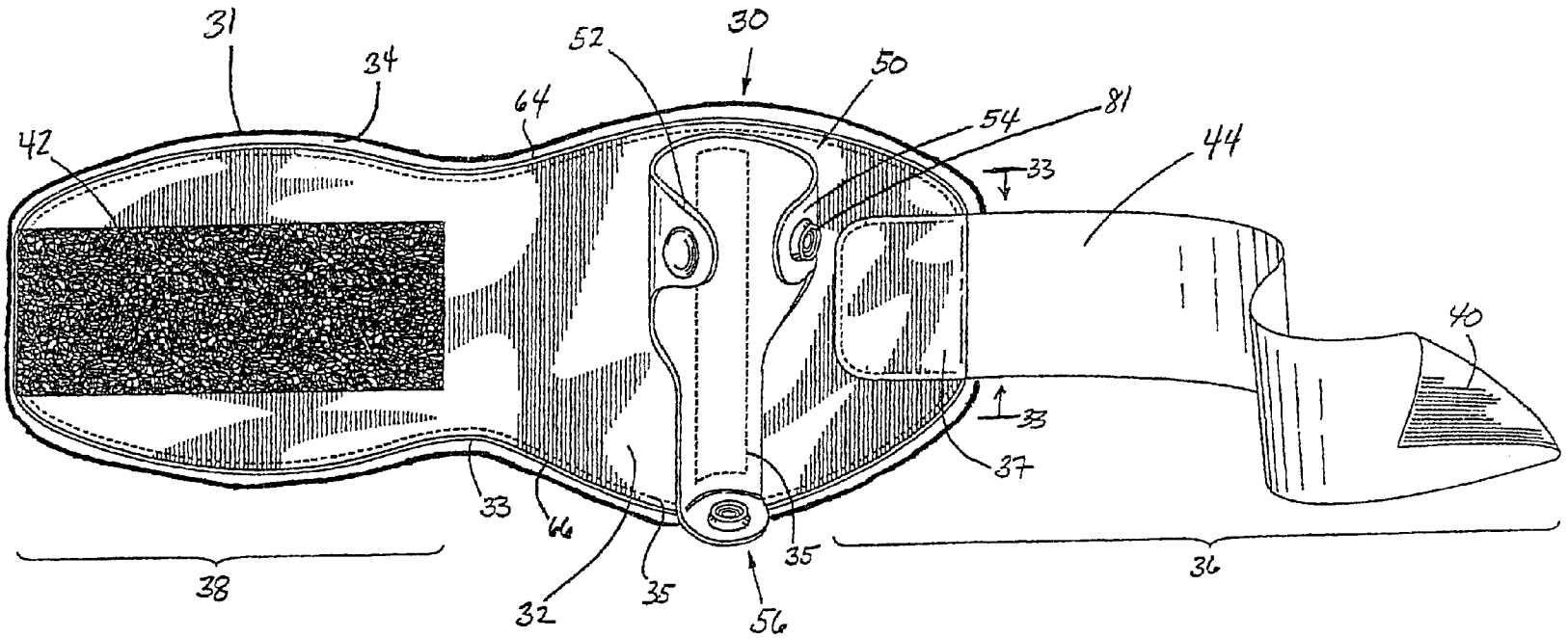
FIG. 3 is a planar view of the preferred baton scabbard of FIG. 2 shown removed from the user with the ends in a disengaged position.

A presently preferred embodiment of the invention is described below with reference to the drawings, in which like reference numerals refer to like elements in the various views. The baton scabbard 30 as shown in FIGS. 2 and 3, is designed to be worn around the lower leg of a user and to releasably secure an expandable baton 10. FIG. 2 shows a baton scabbard 30 according to a presently preferred embodiment as worn by the user, with the baton 10 retained in place against the lower leg of the user, just above the ankle. The baton 10 may be quickly freed from the scabbard 30 and whipped into an extended, operational position for use as a defensive or intermediate force weapon.

The baton scabbard 30 includes a main body portion 32 constructed of leather or other suitable material, such as rubber or ballistic weave nylon. The main body portion 32 preferably includes a backing 34 constructed of suitably soft material to be placed in contact with the wearer's leg, either directly in contact with skin or over clothing. A preferred material for the backing 34 comprises a pre-compacted felt padding which has been found to have some resistance to matting when exposed to moisture such as perspiration. Compaction of the backing can cause improper fit and therefore improper securement of the baton to the wearer. Any suitable method may be employed for adhering the backing 34 to the main body portion 32, however, the applicant has found stitching with a high strength thread affords ease of manufacture and high durability.

The main body portion 32 of the preferred embodiment, as best shown in FIG. 3, includes a curved perimeter 31 having an upper edge 64 and a lower edge 66. The curvature of the main body portion perimeter 31 allows for reduced widths 33, located in the middle of the main body portion and at the point the first and second ends 36 and 38 meet when encircling a limb. The reduced widths 33 generally align with the posterior and anterior portions of the wearer's leg. It will be appreciated that while the baton 10 is positioned at the side of the user's leg (FIG. 2) the reduced widths 33 limit obstruction of the flexion of the user's calf muscle or ankle.

The main body portion 32 includes a first end 36 and a second end 38 and provides a length sufficient to encircle a user's limb and be fastened. The first end 36 is provided with a fastener 40 for fastening the first end 36 around the user's limb and to a cooperating fastener 42 on the second end 38 of the main body portion 32. In the preferred embodiment, such as that depicted in FIG. 3, the first end 36 includes an elongated securing strap 44 having a hook or pile type fastener applied to substantially the entire inner surface thereof. The fastener 42 of the second end 38 includes the complimentary hook or pile type fastener applied to the outer surface thereof to cooperate and secure the baton scabbard 30 to a user's limb. It also allows for easy non-obtrusive fastening. The securing strap 44 is preferably affixed to the main body portion 32 by means of stitching with a thread of suitable strength. The area of attachment for the securing strap 44 is preferably reinforced with an additional leather portion 37 (or other suitable material).

The securing strap 44 generally comprises a synthetic woven fabric, such as nylon, which may conveniently be cut with ordinary scissors to differing lengths to accommodate different diameters of legs. The use of the securing strap 44 allows the weight of the scabbard 30 to be minimized while retaining the length necessary to encircle a user's limb. The securing strap 44 incorporating a hook and pile fastener further provides for finely adjustable securing with the complimentary hook and pile fastener of the second end 38.

The skilled artisan will appreciate that other methods of fastening the first end 36 to the second end 38 may be employed. For example, the first end 36 may comprise an elongated leather portion having a plurality of apertures that are adapted to be engaged by a conventional buckle incorporated on the second end 38. Any suitable fastening mechanism suitable to fasten the first end 36 to the second end 38 may be used so long as the body portion 32 remains secured to the user's limb so that the baton 10 can be readily released.

In an alternative embodiment of the invention, the main body portion 32 of the scabbard may be a continuous band including an elastic portion such that the scabbard is worn by the user much like an elastic ankle or a knee brace would be worn.

The scabbard 30 further includes a retainer assembly 50 adapted to secure a baton to the body portion 32 and adapted for quick release of the baton. The retainer assembly 50 includes a retainer member 59 and a support member 56. The skilled artisan will appreciate that the retainer member 59 and support member 56 may each be independently affixed to the main body so long as the general orientation and cooperation is adhered to. The baton 10 is engaged by the retainer assembly 50 at end 5 with the support member 56 and at the handle with retainer member 59. As shown in FIG. 3, the retainer assembly 50 is affixed to the middle of the main body portion 32 between the first end 36 and second end 38. The retainer assembly 50 is positioned such that the retainer member 59 is oriented at a point near the upper edge 64 and above the support member 56 such that the baton handle 9 may be received and engaged by the retainer member 59 and retained in a substantially vertical orientation when the scabbard 30 is in use (see FIGS. 2 and 3). The retainer assembly 50 is preferably constructed in a one-piece fashion from suitable material such as leather, ballistic weave nylon or other flexible, non-stretchable material. The adherence of the retainer assembly 50 to the main body portion 32 may be accomplished by any suitable technique, however, stitching 35 has been found to provide both strength and durability.

The retainer member 59 includes a first flap 52 and a second flap 54. Flaps 52 and 54 encircle the baton handle and secure the baton 10 from movement in horizontal directions when the first flap 52 and second flap 54 are joined. To join the flaps a quick release mechanism is used. The quick release mechanism includes a metal male snap element 53 that may be permanently attached to the first flap 52 by a rivet or other suitable means. The male snap element 53 is adapted to be received by a complimentary female snap element 55 incorporated into the second flap 54. Likewise, the female snap element 55 may be permanently secured by way of a rivet or other suitable means.

Figure 4:
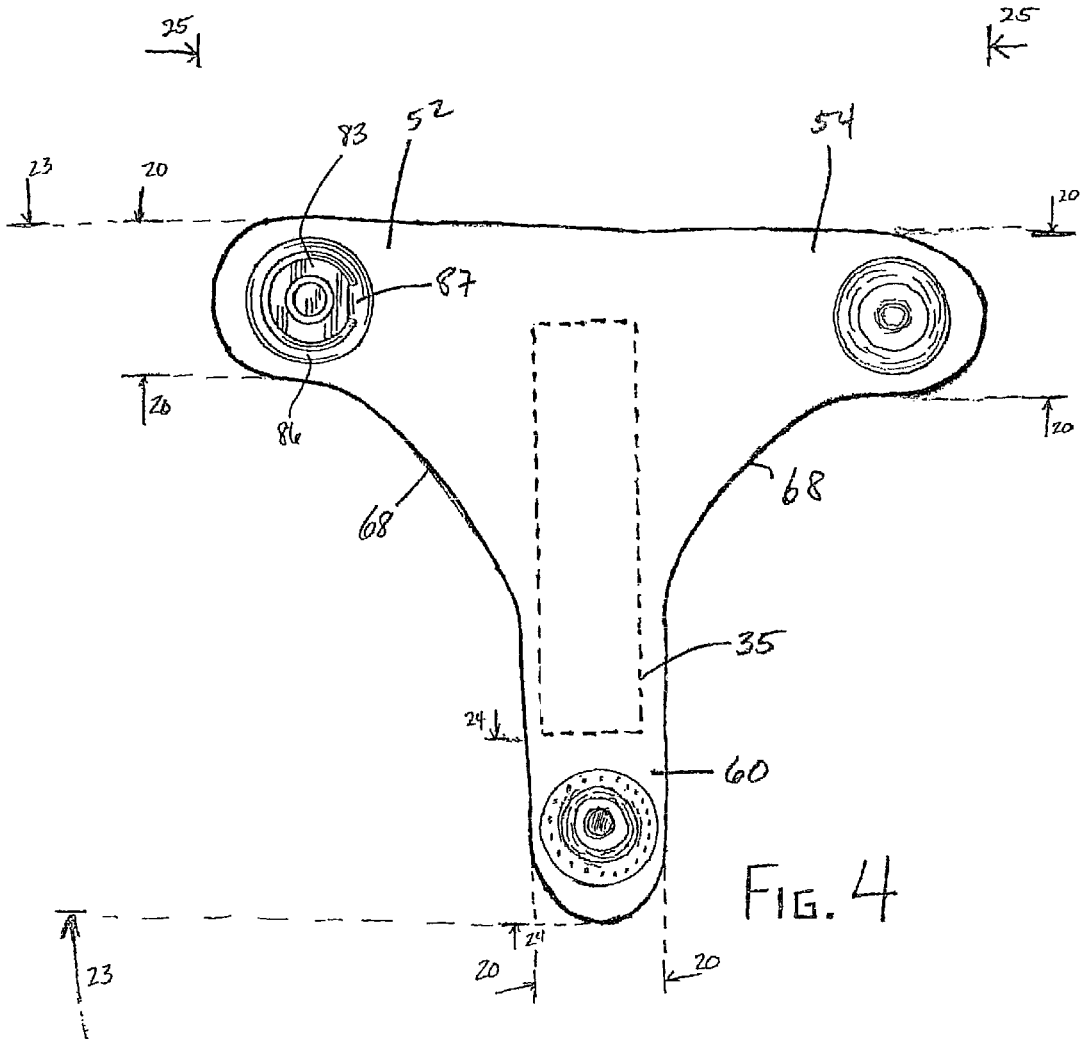
FIG. 4 is a planar view of the retainer assembly of 2A shown removed from the scabbard.

More preferably, the first and second flap snap elements are of a one-way release system. If a one-way release system is used, the flaps may only be separated if the first flap is first pulled in the appropriate direction (generally from the front to the back) to release the baton 10. The one-way release system assures that the baton scabbard 30, when used properly by law enforcement personnel, is not inadvertently opened thereby releasing the baton 10. A one-way release snap system is shown and described in U.S. Pat. No. 5,217,151 incorporated herein by reference. In the preferred embodiment (as best shown in FIG. 4), a one-way release is used, which includes a flat or abutment member 87 on the rolled lip 86 of the female snap element, prohibiting removal of the post 81 from the snap socket 83 unless the post 81 is first pulled in the direction of arrow A to remove the post 81 from the snap socket around the abutment member 87. Although snaps have been shown, any fastener system capable of releasably securing the baton 10 while enabling a quick and easy release of the baton 10, and preferably inhibiting the unwanted release, may be used.

Figure 1C:
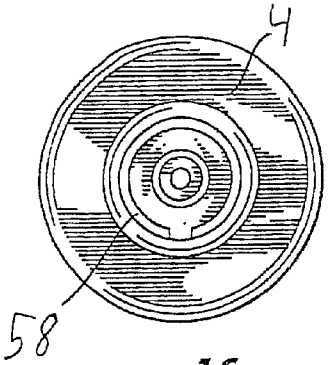
FIG. 1C. (PRIOR ART)
FIG. 1C is a prior art end view of the expandable baton of FIGS. 1A and 1B depicting the female snap element incorporated into the end cap which cooperates with a complimentary male snap element of the baton retainer.

Below the retainer member is support member 56. The support member 56 is adapted to engage the baton 10 to substantially prevent movement of the baton 10 in a downward direction when the baton is stowed. In a preferred embodiment depicted in FIGS. 2A,3 and 4, the support member 56 comprises a third flap 51 of suitable material, such as leather, having a female snap element 57. The female snap element 57 is adapted to be received by a complimentary male snap element 58 incorporated in the end cap 4 of the baton 10 (see FIG. 1C).

Figure 2A:
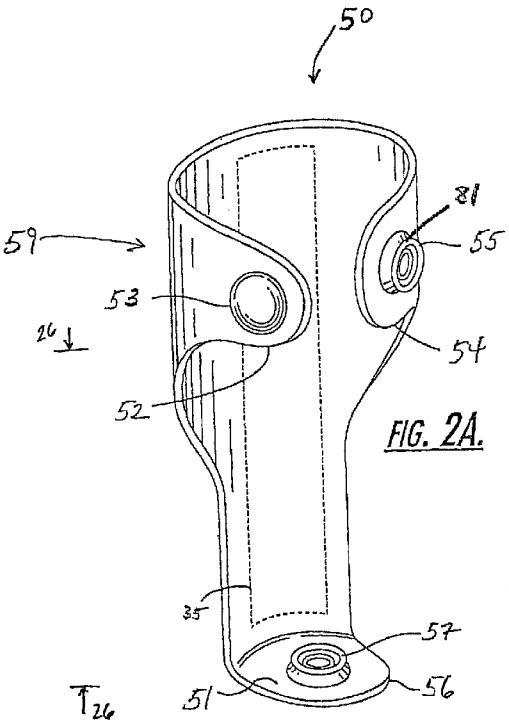
FIG. 2A is a perspective of the preferred retainer assembly, shown removed from the main body portion in order to further illustrate the elements thereof, wherein the support member comprises a flap having a complimentary male snap element which cooperates with the female snap element incorporated into the baton end cap.
Figure 2B:
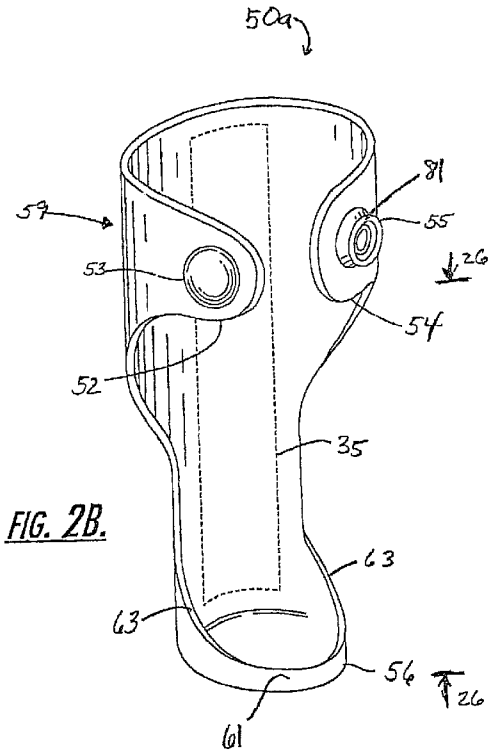
FIG. 2B is a perspective of an alternative embodiment of a preferred retainer assembly, shown removed from the main body portion in order to further illustrate the elements thereof, wherein the support member comprises a shallow pocket adapted to receive a baton end.

FIG. 2B shows an alternative embodiment of retainer assembly 50. Retainer assembly 50*a*, shown in FIG. 2B, is the same as 50 except the support member 56 comprises a shallow pocket 62 designed for slidably receiving an end of the baton 10. The pocket 62 prevents the downward movement of the baton 10 while the shallow wall 61 prevents the horizontal movement of the extreme end of the baton 10. The shallow or reduced wall 61 limits the frictional forces encountered between the walls of the pocket and the baton 10 during withdrawal. The limited frictional forces allow the baton 10 to be quickly withdrawn from the retainer assembly without regard to the direction of withdrawal, as required by known scabbards, to prevent binding or jamming. This alternative embodiment of the support member 56 also allows for the stowing of batons that do not include a snap element incorporated into the end cap 4. The pocket 62 may include tapered side walls 63 to increase the support strength of the pocket 62 while not substantially obstructing the angle at which the baton 10 may be removed from the scabbard. The baton 10 may also be stowed in a manner such that the knob 18 rests in the pocket 62 if preferred by the user. Further, a male snap element may be incorporated into the bottom of the pocket 62, giving the alternative retainer assembly 50 of FIG. 2B a greater degree of versatility for the user.

FIG. 4 illustrates retainer assembly 50 removed from the body portion 32 and laid flat. The flaps 52, 54 and 60 preferably have a width, as depicted by lines 20, of approximately one inch and a wingspan, depicted by lines 25, of approximately 5¼ inches. The flaps 52 and 54 may include tapered sidewalls 68. The third flap has a length marked by lines 24 of approximately 1¼ inch. The height of the retainer assembly 50, marked by lines 23, is approximately 4¾ inches. As best shown in FIGS. 2 and 2A, the retainer assembly 50 leaves an approximately 2¾ inch portion, marked by lines 26, of the baton handle exposed.

In the illustrated embodiment of FIG. 2, the scabbard 30 is secured around a user's leg such that the baton 10 is positioned on the outside of the leg in a substantially vertical orientation. An end portion of the baton 10 is positioned above the ankle and extends up the leg, thus allowing a pant or trouser leg to be pulled over the scabbard 30 to provide concealment. One of the features of the scabbard is that it may accommodate batons of different lengths, and if a longer baton is secured it will simply extend further above the retainer assembly 50. While the scabbard 30 is shown positioned on the outside of the user's leg, one will appreciate that the scabbard 30 may be worn such that the baton 10 is located at any position around the leg. Further, the scabbard may be placed on the right or left leg simply by reversing the direction by which the first and second ends encircle the leg. Thus, the scabbard provides for great versatility in positioning to accommodate the preferences of different users.

In accordance with another feature of the invention, the baton 10 may be quickly and easily removed from the scabbard for deployment with two motions. With reference to FIG. 2, removal may be quickly and easily achieved by the user reaching down with the right hand (the appropriate hand is dependent on the positioning of the baton 10) and grasping the exposed handle of the baton 10. While grasping the handle of the baton 10, the user positions the right thumb behind the extended overlapping portion of the first flap 52 and releases the snap that fastens the first flap 52 with the second flap 54. As previously noted, the preferred embodiment includes a one-way release snap system, therefore the snaps must be pulled apart in the one direction marked by line A.

The second motion is to draw the baton 10 from the support member 56 and this can advantageously be accomplished in nearly any direction, including upward, outward, rearward, forward or any combination of these directions. After the second releasing motion, the baton 10 is completely free from the scabbard and may be deployed by the user simply grasping the handle and swinging the baton sharply in an arc. Doing so causes the inner telescoping sections to thrust outward by centrifugal force until the flares and swages of the sections engage. When swung hard enough, the sections are locked together so tightly that only a sharp axial blow on a very hard object, for example a concrete wall, can break the deadlock joint between sections.

The baton 10 may easily be returned to the scabbard by either first engaging the fasteners of the flaps 52 and 54 and sliding the baton through the loop made therefrom and engaging the support member 56. Preferably, the baton 10 end is first engaged by the support member 56 and the flaps 52 and 54 engaged around the baton handle.

Figure 1A:
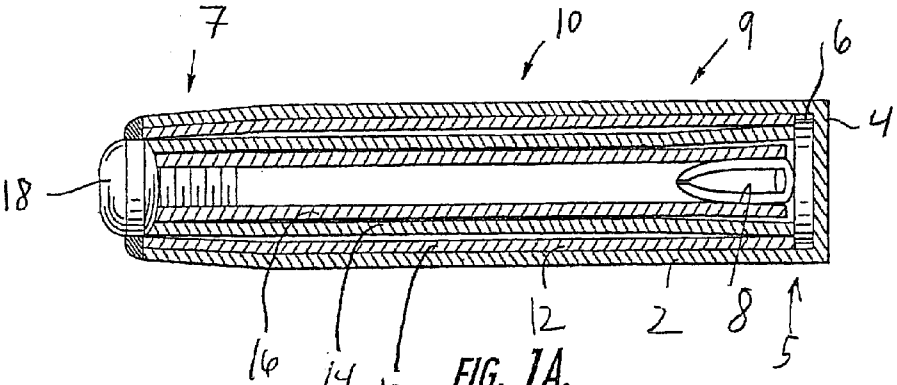
FIG. 1A. (PRIOR ART)
FIG. 1A is a prior art cross-sectional view of an expandable baton in a retracted position, such a baton being a suitable type for employment with the present inventive scabbard.
Figure 1B:
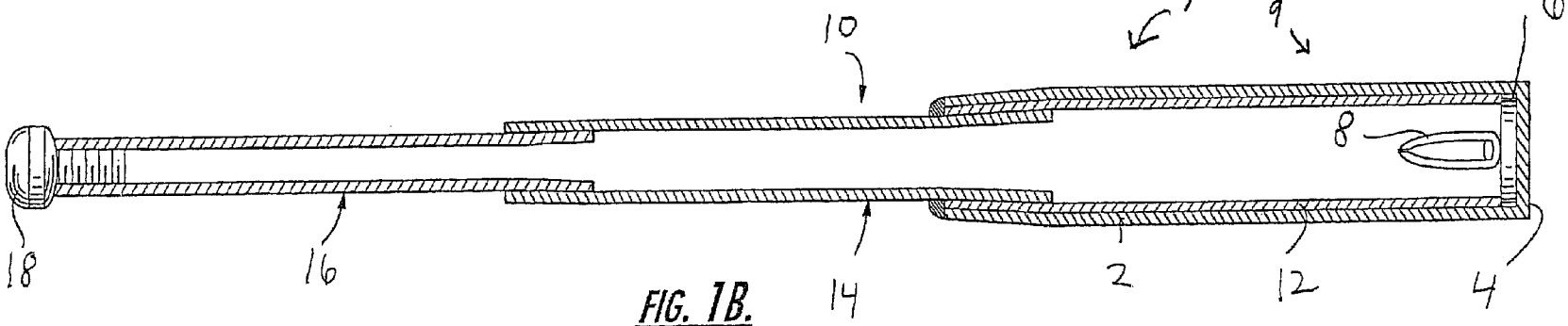
FIG. 1B. (PRIOR ART)
FIG. 1B is a prior art cross-sectional view of the expandable baton of FIG. 1A shown in an extended position.

A preferred baton for employment with the present inventive scabbard, shown in FIGS. 1A and 1B, is described in U.S. Pat. No. 5,348,297, assigned to Armament Systems and Procedures, Inc.

While the description has been given with reference to an expandable baton, one skilled in the art will also appreciate that other batons or devices (such as flashlights or personal defense dispensers) may be incorporated into the scabbard as well. The main body portion 32 may also include multiple retainer assemblies to stow additional equipment, such as flashlights or chemical spray dispensers, upon the same scabbard 30.

Various features of the invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A scabbard for releasably securing a baton to a limb of a user, the scabbard comprising:

(A) a body portion formed of flexible material adapted to be worn about the limb of a user, said flexible material configured to encircle at least a portion of the limb;

(B) a retainer assembly affixed to said body portion, said retainer assembly including a retainer member to releasably encircle the baton; and (C) a support member configured to underlie and releasably hold a non-extendable end of the baton, where said support member does not have an aperture that would allow telescoping sections of the baton to move downwardly through.

2. The scabbard of claim 1, wherein said body portion comprises a first end and a second end, said first end including a first end fastener for fastening said first end to said second end and said second end including a complementary second end fastener for fastening said second end to said first end.

3. The scabbard of claim 2, wherein said first end includes an inner surface, and said second end includes an outer surface and wherein complementary hook and pile fastener is applied to said inner surface and said outer surface thereby enabling the scabbard to be securely positioned in a plurality of positions about the user's limb.

4. The scabbard of claim 3, wherein said first end includes an elongated securing strap constructed of woven synthetic fiber having an inner surface and wherein complementary hook and pile fastener is applied to substantially the entire inner surface of said strap to cooperated with the complementary hook and pile fastener of said second end, thereby enabling said scabbard to be secured in a plurality of positions about the user's limb.

5. The scabbard of claim 1, wherein said retainer member includes a first flap and a second flap, said first flap having a first flap fastener for releasably fastening said first flap to said second flap and said second flap having a complimentary second flap fastener for releasably fastening said second flap to said first flap.

6. The scabbard of claim 5, wherein said first and second fasteners comprise a set of complimentary snap elements.

7. The scabbard of claim 6, wherein at least one of the first and second fasteners include a flat portion to facilitate only one-way release of the flaps.

8. The scabbard of claim 1, wherein said support member comprises a third flap having a snap element enabling an end portion of the baton having a complimentary snap element to be snalpped to said support member.

9. The scabbard of claim 1, wherein the support member comprises a shallow pocket having tapered side walls and adapted for receiving and supporting an end of the baton.

10. The scabbard of claim 1, wherein said retainer assembly is formed from a single piece of leather.

11. The scabbard of claim 1, wherein said body portion includes a backing of a soft material.

12. The scabbard of claim 11, wherein said backing comprises precompacted felt.

13. The scabbard of claim 1, wherein the retainer assembly is affixed to the main body portion by way of stitching with a suitable thread.

14. A scabbard for releasably securing a baton to a limb of a user, the baton having a handle with an end portion, and at least one telescoping section extendable from the handle in a direction away from the end portion, the scabbard comprising:

(A) a body portion having a first end, a second end, an upper edge, a lower edge and a backing, said body portion adapted to encircle and be worn about the limb of a user, said first end including a first end fastener for fastening said first end to said second end and said second end including a complementary second end fastener for fastening said second end to said first end; and (B) a retaining assembly affixed to said body portion, said retainer assembly including a retainer member and a support member, said retainer member having a first flap and a second flap, said flaps adapted to encircle a baton handle, said first flap having a first snap element for releasably fastening said first flap to said second flap and said second flap having a complementary second snap element for releasably fastening said second flap to said first flap, said support member positioned proximate the lower edge of said body portion and adapted to receive the end portion of the handle of the baton to limit the downward movement of the baton and where said support member does not have an aperture that allows telescoping sections of the baton to move downwardly through.

15. The scabbard of claim 14, wherein said first and second end fasteners comprises complementary hook and pile fasteners thereby enabling the scabbard to be securely positioned in a plurality of positions about the user's limb.

16. The scabbard of claim 14, wherein said support member comprises a third flap having a snap element adapted to receive and cooperate with a complimentary snap element positioned on an end of the baton enabling the baton to be snapped to the support member.

17. The scabbard of claim 16, wherein said retainer assembly is formed from a single piece of material.

18. The scabbard of claim 17, wherein said single piece of material is leather.

19. The scabbard of claim 14, wherein the support member comprises a shallow pocket having tapered walls for receiving and supporting an end of the baton.

20. The scabbard of claim 15 wherein said retainer assembly is formed from a single piece of material.

21. The scabbard of claim 14, wherein said first end includes an elongated securing strap constructed of woven synthetic fiber having an inner surface and wherein complimentary hook and pile fastener is applied to substantially the entire inner surface of the strap to cooperated with the complimentary hook and pile fastener of the second end, thereby enabling the scabbard to be secured in a plurality of positions about the user's limb.

22. The scabbard of claim 14 wherein the backing comprises a felt pad.

23. The scabbard of claim 14, wherein said retainer assembly is positioned on the main body portion such that when the scabbard is worn by the user and the baton is releasably secured by said retainer assembly, the baton is oriented in a substantially vertical orientation with the first and second flaps positioned substantially above the support member.

24. The scabbard of claim 14, wherein said first and second snap elements comprise a complimentary set of one-way release snaps.

25. A scabbard for releasably securing a baton to a limb of a user, the baton having a handle with an end portion having a first releasable fastener element, and at least one telescoping section extendable from the handle in a direction away from the first fastener element, the scabbard comprising:

(A) a body portion formed of flexible material adapted to be worn about the limb of a user and configured to encircle a portion of the limb;

(B) a retainer assembly affixed to said body portion, said retainer assembly including a retainer member to releasably encircle the baton; and (C) a support member having a substantially planar face and a second releasable fastener element configured to abut the end portion of the handle, the second releasable fastener element releasably locking with the first releasable fastener element to releasably secure the handle and where the support member does not have an aperture that allows telescoping sections of the baton to move downwardly through.

* * * * *